US006231696B1

(12) United States Patent
Hensger et al.

(10) Patent No.: US 6,231,696 B1
(45) Date of Patent: May 15, 2001

(54) METHOD OF MANUFACTURING MICROALLOYED STRUCTURAL STEEL

(75) Inventors: Karl-Ernst Hensger, Düsseldorf (DE); Robert F. Davis, Wilmette, IL (US)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/276,206

(22) Filed: Mar. 25, 1999

(30) Foreign Application Priority Data

Mar. 31, 1998 (DE) ..... 198 14 223

(51) Int. Cl.[7] ..... C21D 1/09

(52) U.S. Cl. ..... 148/541; 148/546; 148/602; 148/654

(58) Field of Search ..... 148/541, 546, 148/602, 654

(56) References Cited

U.S. PATENT DOCUMENTS 5,393,358 * 2/1995 Shikanai et al. ..... 148/541
6,030,470 * 2/2000 Hensger et al. ..... 148/541

FOREIGN PATENT DOCUMENTS 197 25 434 A1 12/1998 (DE) .
0368048 5/1990 (EP) .
0413163 2/1991 (EP) .

* cited by examiner

*Primary Examiner*—Roy King
*Assistant Examiner*—Nicole Coy
(74) *Attorney, Agent, or Firm*—Friedrich Kueffner

(57) ABSTRACT

A method of manufacturing microalloyed structural steels by rolling in a CSP plant or compact strip production plant, wherein the cast slab strand is supplied divided into rolling lengths through an equalizing furnace to a multiple-stand CSP rolling train and is continuously rolled in the rolling train into hot-rolled wide strip, wherein the strip is cooled in a cooling section and is reeled into coils, and wherein, for achieving optimum mechanical properties, a controlled structure development by thermomechanical rolling is carried out as the thin slab travels through the CSP plant. For manufacturing high-strength microalloyed structural steels with a yield point of ≧480 MPa, the available strengthening mechanisms are utilized in a complex manner in order to achieve an optimum property complex with respect to strength and toughness of the structural steels, by carrying out, in addition to the thermomechanical rolling with the method steps according to U.S. patent application Ser. No. 09/095,338 filed Jun. 10, 1998, now U.S. Pat. No. 6,030,470, a further influence on the structure of the thin slabs by changing the material composition in order to achieve a specific mixed crystal strengthening by an increased silicon content and/or a complex mixed crystal strengthening by an increased content of copper, chromium, nickel.

5 Claims, No Drawings

METHOD OF MANUFACTURING MICROALLOYED STRUCTURAL STEEL

BACKGROUND OF THE INVENTION

1. Field of the Invention

The present invention relates to a method of manufacturing microalloyed structural steels by rolling in a CSP plant or compact strip production plant, wherein the cast slab strand is supplied divided into rolling lengths through an equalizing furnace to a multiple-stand CSP rolling train and is continuously rolled in the rolling train into hot-rolled wide strip, wherein the strip is cooled in a cooling section and is reeled into coils, and wherein, for achieving optimum mechanical properties, a controlled structure development by thermomechanical rolling is carried out as the thin slab travels through the CSP plant.

2. Description of the Related Art

EP-A-0368048 discloses the rolling of hot-rolled wide strip in a CSP plant, wherein continuously cast initial material, after being divided into rolling lengths, is conveyed through an equalizing furnace directly to the rolling mill. Used as the rolling mill is a multiple-stand mill in which the rolled lengths which have been raised to a temperature of 1100° C. to 1130° C. in the equalizing furnace are finish-rolled in successive work steps, wherein descaling is carried out between the work steps.

In order to achieve an improvement of the strength and the toughness properties and the corresponding substantial increase of the yield strength and the notch value of a rolled product of steel, EP-A-0413163 proposes to thermomechanically treat the rolling stock.

In contrast to a normalizing deformation in which the final deformation takes place in the range of the normal annealing temperature with complete recrystallization of the austenite, in the case of the thermomechanical deformation temperature ranges are maintained for a specified deformation rate in which the austenite does not recrystallize or does not significantly recrystallize.

A significant feature of the thermomechanical treatment is the utilization of the plastic deformation not only for manufacturing a defined product geometry, but also especially for adjusting a desired real structure and, thus, for ensuring defined material properties, wherein non-recrystallized austenite is subjected to the polymorphous gamma-alpha-deformation (in the normalizing deformation the austenite is already recrystallized).

Prior to deformation in a conventional rolling mill, conventional slabs when used in the cold state are subjected to the polymorphous transformations:

melt→ferrite (delta)→austenite $A_1$ (gamma)→ferrite (alpha)→austenite $A_2$ (gamma)

while the following is true for the CSP technology:

melt→ferrite (delta)→austenite $A_1$ (gamma)

with an increased oversaturation of the mixed crystal austenite and an increased precipitation potential for carbonitrides from the austenite.

In order to utilize the peculiarities of the structure development during thermomechanical rolling in CSP plants in an optimum manner, it has been proposed in prior U.S. patent application Ser. No. 09/095,338 filed Jun. 10, 1998, now U.S. Pat. No. 6,030,470 corresponding to German Patent Application 1972534.9-24, for adapting to the thermal prior history of the thin slabs introduced into the CSP rolling plant with a cast structure, to allow a complete recrystallization of the cast structure which starts at the thermomechanical first deformation, before a further deformation takes place. As a result of this measure, and by adjusting defined temperature and shape changing conditions, a controlled structure development is achieved in the rolling stock as it travels through the CSP plant and the thermomechanical deformation is adapted in an optimum manner to the specific process parameters of the CSP method with its specific prior thermal history.

SUMMARY OF THE INVENTION

It is the object of the present invention to provide suitable measures for further increasing the strength development achieved by the method steps of the U.S. Patent Application mentioned above, so that it is ensured that the microalloyed ferretic-pearlitic structural steel manufactured by the CSP process meet the requirements of the highest strength class with yield points ≧480 MPa and, as a result of these measures, the CSP plant, the CSP process and the material being processed are adapted to each other in an optimum manner to an even greater extent.

In accordance with the present invention, for manufacturing high-strength microalloyed structural steels with a yield point of ≧480 MPa, the available strengthening mechanisms are utilized in a complex manner in order to achieve an optimum property complex with respect to strength and toughness of the structural steels, by carrying out, in addition to the thermomechanical rolling with the method steps according to U.S. patent application Ser. No. 09/095,338 filed Jun. 10, 1998, now U.S. Pat. No. 6,030,470, a further influence on the structure of the thin slabs by changing the material composition in order to achieve a) a specific mixed crystal strengthening by an increased silicon content and/or b) a complex mixed crystal strengthening by an increased content of copper, chromium, nickel.

The various features of novelty which characterize the invention are pointed out with particularity in the claims annexed to and forming a part of the disclosure. For a better understanding of the invention, its operating advantages, specific objects attained by its use, reference should be had to the following descriptive matter in which there are described preferred embodiments of the invention.

Consequently, the measure according to the present invention combines metallurgically useful strength-increasing operating mechanisms with each other and adapts them in an optimum manner for use in the CSP process.

These are particularly the strength-increasing mechanisms of grain boundary solidification and precipitation hardening, wherein these mechanisms are influenced favorably by the thermomechanical rolling with process steps according to U.S. patent application Ser. No. 09/095,338 filed Jun. 10, 1998, now U.S. Pat. No. 6,030,470, and which are triggered essentially by the microalloying elements, for example, titanium, niobium, vanadium and others.

In accordance with the present invention, in addition to these strength-increasing mechanisms, a mixed crystal strengthening is produced in a defined manner.

In high-strength ferretic/pearlitic microalloyed structural steels, the mixed crystal strengthening is preferably effected by manganese. However, it has been found that, for safely ensuring highest yield points in the range of ≧480 MPa in CSP plants, the additional and targeted alloying with additional elements is useful and necessary for the highest strength classes.

Two aspects are particularly significant in this connection:

the mixed crystal strengthening is added to the step of precipitation hardening; this makes it possible to utilize the CSP process for achieving higher strength classes in the material group of ferretic/pearlitic structural steels;

the mixed crystal strengthening takes place in such a way that, for example, due to the alloy element silicon, the strengthening remains essentially unaffected by the hot deformation; in other words, the strengthening does not lead, for example, to deformation-induced precipitation. Consequently, such a steel has a quieter behavior in the train, because it is strengthened to a lesser extent by the deformation itself; therefore, the steel is more easily manipulated by control technology.

In view of these aspects, the following alloying elements can be used in accordance with the present invention in addition to manganese with the following contents by weight:

| | |
|---|---|
| silicon | 0.41–0.60% |
| copper | 0.11–0.30% |
| chromium | 0.20–0.60% |
| nickel | 0.10–0.60% |

The addition of copper in the above-mentioned quantities has the effect that, aside from the mixed crystal strengthening, when exceeding the solubility limit in the ferrite, but not in the austenite, an additional precipitation hardening occurs during the deformation by $\epsilon$–Cu. However, it must be taken into consideration in this connection that copper frequently must be used together with nickel in order to prevent solder rupture. When the steel production takes place through a line with an electric arc furnace and a ladle furnace, copper inevitably is already frequently present. In accordance with conventional recommendations, the copper content should not exceed an amount of 0.1%. However, it has been found that for the material group of high-strength structural steels this value can be increased to a value of 0.3% copper in order to achieve an additional mixed crystal strengthening in this manner.

When carrying out the steel production through a line with an oxygen blowing furnace and a ladle furnace, such a high copper content can also be alloyed in additionally. However, this has the disadvantage that the flexibility is lost to the extent that downward blowing of the once copper-alloyed ladle is no longer possible which would be desirable, for example, in the case of production interruptions or an alternative use of an already produced ladle.

The situation is different when chromium, nickel and silicon are added because these elements can all be adjusted in the oxygen blowing furnace. Consequently, as an alternative to the addition of copper, it is possible to add nickel alone and/or chromium and/or silicon in order to achieve the desired mixed crystal strengthening.

In the following, an example is used to explain in more detail the mixed crystal strengthening.

A microalloyed structural steel having the composition of, in percent per weight, C<0.07; Mn=1.3: Si≦0.35; Cu≦0.05; Ni≦0.05; Cr≦0.05; Mo≦0.05; Nb=0.02; V=0.08; N=180 ppm resulted with the thermomechanical treatment with the method steps according to U.S. patent application Ser. No. 09/095,338 the following properties: yield point 480 MPa, tensile strength 570 MPa, elongation 21%.

By the additional mixed crystal strengthening with an increased addition of silicon in accordance with the analysis: C≦0.07; Mn=1.3; Si=0.60; Cu≦0.05; Ni≦0.05; Cr≦0.05; Mo≦0.05; Nb=0.02; V=0.08; N=180 ppm, and by also carrying out the treatment in accordance with the method steps U.S. patent application Ser. No. 09/095,338, the following properties were achieved: yield point 565 MPa, tensile strength 650 MPa, elongation 22%.

Accordingly, in addition to the method steps of the thermomechanical treatment, the method of the present invention for mixed crystal strengthening makes it possible to achieve significant strength increases, so that completely new applications for the produced structural steel become available.

In a similar manner to the example described above, the other alloy elements mentioned above, i.e., copper, nickel, chromium, can also be used as mixed crystal strengtheners. The strength increase is particularly effective if alloying is not only carried out with a single one of the above-mentioned elements which are substitutionally dissolved in iron, but are utilizing the elements in a complex manner in combination.

While specific embodiments of the invention have been shown and described in detail to illustrate the inventive principles, it will be understood that the invention may be embodied otherwise without departing from such principles.

We claim:

1. In a method of manufacturing microalloyed structural steels by rolling in a CSP plant, wherein a cast slab strand is divided into rolling lengths and is supplied through an equalizing furnace to a multiple-stand CSP rolling train and is continuously rolled in the CSP rolling train into hot-rolled wide strip, is cooled in a cooling stretch and is reeled into coils, wherein the improvement comprises, for achieving optimum mechanical properties in hot-rolled wide strip by thermomechanical rolling, carrying out a controlled structure development as the thin slabs travel through the CSP plant, the method comprising the steps of:

(a) changing the cast structure by adjusting defined temperature and shape changing conditions during a first transformation, wherein the temperature is above the recrystallization stop temperature, so that a complete recrystallization of the cast structure takes place at least one of during and after the first deformation and prior to a beginning of a second deformation step;

(b) carrying out a deformation in the last roll stands at temperatures below the recrystallization stop temperature, wherein the deformation is not to drop below a quantity of 30% and a final rolling temperature is near the austenite/ferrite transformation temperature;

(c) carrying out a controlled cooling of the hot-rolled strips in the cooling stretch, wherein the polymorphous transformation of the austenite takes place at a temperature between the austenite/ferrite transformation temperature and the bainite start temperature; and further comprising, for achieving high-strength microalloyed structural steels with a yield point of ≧480 MPa and with optimum properties with respect to strength and toughness, the additional step of effecting an additional structure influence in the thin slab by changing the material composition thereof by one of (d) an increased silicon content for a targeted mixed crystal strengthening, and (e) an increased content of copper, chromium, nickel for a complex mixed crystal strengthening.

2. The method according to claim 1, wherein the increased contents are in the following ranges:

| | |
|---|---|
| silicon | = 0.41 to 0.60% |
| copper | = 0.11 to 0.30% |
| chromium | = 0.20 to 0.60% |
| nickel | = 0.10 to 0.60% |

3. The method according to claim 1, comprising selecting a type and quantity of the added elements such that the mixed crystal strengthening supplements a precipitation hardening which takes place during travel of the thin slab through the CSP plant.

4. The method according to claim 1, comprising selecting a type and quantity of the added elements such that the mixed crystal strengthening takes place such that the mixed crystal strengthening is essentially unaffected by the thermal deformation and does not result in deformation-injecting precipitation.

5. A microalloyed high-strength structural steel manufactured by a rolling method in a CSP plant, wherein a cast slab strand is divided into rolling lengths and is supplied through an equalizing furnace to a multiple-stand CSP rolling train and is continuously rolled in the CSP rolling train into hot-rolled wide strip, is cooled in a cooling stretch and is reeled into coils, the improvement comprising, for achieving optimum mechanical properties in hot-rolled wide strip by thermomechanical rolling, carrying out a controlled structure development as the thin slabs travel through the CSP plant, the method comprising the steps of:

(a) changing the cast structure by adjusting defined temperature and shape changing conditions during a first transformation, wherein the temperature is above the recrystallization stop temperature, so that a complete recrystallization of the cast structure takes place at least one of during and after the first deformation and prior to a beginning of a second deformation step;

(b) carrying out a deformation in the last roll stands at temperatures below the recrystallization stop temperature, wherein the deformation is not to drop below a quantity of 30% and a final rolling temperature is near the austenite/ferrite transformation temperature;

(c) carrying out a controlled cooling of the hot-rolled strips in the cooling stretch, wherein the polymorphous transformation of the austenite takes place at a temperature between the austenite/ferrite transformation temperature and the bainite start temperature; and for additionally achieving high-strength microalloyed structural steels with a yield point of ≧480 MPa and with optimum properties with respect with respect to strength and toughness, the additional step of affecting an additional structure influence in the thin slab by changing the material composition thereof by one of (d) an increased silicon content for a targeted mixed crystal strengthening, and (e) an increased content of copper, chromium, nickel for a complex mixed crystal strengthening, wherein the material composition including the alloying elements silicon and/or copper, chromium, nickel added for the mixed crystal strengthening is selected such that a travel time of the strip in the CSP plant is sufficient to allow them strength-increasing solid body reactions including the mixed crystal strengthening during the thermomechanical rolling and during the recrystallization phases.

* * * * *